US010584706B2

(12) United States Patent
Pal

(10) Patent No.: US 10,584,706 B2
(45) Date of Patent: Mar. 10, 2020

(54) RAM FAN DEVICE AND MOTOR COOLING SYSTEMS AND METHODS

(71) Applicant: Hamilton Sundstrand Corporation, Charlotte, NC (US)

(72) Inventor: Debabrata Pal, Hoffman Estates, IL (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 686 days.

(21) Appl. No.: 14/598,572

(22) Filed: Jan. 16, 2015

(65) Prior Publication Data

US 2016/0208819 A1 Jul. 21, 2016

(51) Int. Cl.

| | |
|---|---|
| ***F04D 25/08*** | (2006.01) |
| ***F04D 29/58*** | (2006.01) |
| ***F04D 25/06*** | (2006.01) |
| ***F04D 19/00*** | (2006.01) |

(52) U.S. Cl.

CPC ..... *F04D 25/082* (2013.01); *F04D 19/002* (2013.01); *F04D 25/06* (2013.01); *F04D 25/0606* (2013.01); *F04D 29/5806* (2013.01); *F04D 29/5826* (2013.01); *F04D 19/00* (2013.01)

(58) Field of Classification Search

CPC ..... F04D 29/582; F04D 29/58–5853; F04D 19/00; F04D 19/002; F04D 21/00; F04D 25/06; F04D 25/0606; F04D 25/082; F04D 29/5806–584

USPC ..... 417/366, 368–372; 415/175–179

See application file for complete search history.

(56) References Cited

U.S. PATENT DOCUMENTS

| | | | | |
|---|---|---|---|---|
| 5,350,281 A * | 9/1994 | Hagshenas | F04D 25/082 415/144 |
| 7,976,291 B2 * | 7/2011 | Vinson | F04D 25/082 310/58 |
| 2012/0014784 A1 * | 1/2012 | Hipsky | B64D 13/00 415/177 |

* cited by examiner

*Primary Examiner* — Alexander B Comley

(74) *Attorney, Agent, or Firm* — Locke Lord LLP; Daniel J. Fiorello; Scott D. Wofsy

(57) ABSTRACT

A ram fan device includes a motor disposed in a housing that defines a motor cavity with a fan operatively connected to be driven by the motor and an outlet in fluid communication with the motor cavity. The housing includes a cooling inlet therethrough downstream of the fan and upstream of the motor, the cooling inlet being in fluid communication with the outlet through the motor cavity such that airflow can pass through the cooling inlet through the motor cavity and out the outlet.

6 Claims, 2 Drawing Sheets

RAM FAN DEVICE AND MOTOR COOLING SYSTEMS AND METHODS

BACKGROUND

1. Field

The present disclosure relates to ram fans for use in electronics cooling systems, more specifically to cooling systems for ram fan motors.

2. Description of Related Art

A ram air fan can be disposed in ram air cooling systems (e.g., for aircraft) that are designed to provide airflow over a liquid/air heat exchanger to make up for insufficient ram air, e.g., when a vehicle is moving at a low airspeed, to consistently remove enough heat from the liquid/air heat exchanger. Such heat exchangers can allow the removal of heat from a coolant inside a liquid cooling circuit (e.g., used to cool aircraft electronics).

The motor of the ram air fan itself requires cooling, and is traditionally cooled by ram air traveling from a ram inlet header, through a cooling duct, and into a motor housing to remove heat from the ram air fan motor. The flow is then ejected forward of the fan to rejoin exhaust flow from the from the liquid/air heat exchanger. Since this flow is induced by the ram air fan, such as when an aircraft is at low airspeed, the heat removal due to this induced cooling duct flow is small and can lead to the motor overheating in certain conditions. Also, fine object debris (FOD) that is taken in by the ram air inlet can clog the cooling duct and/or travel to the motor housing and clog airflow therethrough.

Such conventional methods and systems have generally been considered satisfactory for their intended purpose. However, there is still a need in the art for improved cooling systems for ram air fan motors. The present disclosure provides a solution for this need.

SUMMARY

A ram fan device includes a motor disposed in a housing that defines a motor cavity with a fan operatively connected to be driven by the motor and an outlet in fluid communication with the motor cavity. The housing includes a cooling inlet therethrough downstream of the fan and upstream of the motor, the cooling inlet being in fluid communication with the outlet through the motor cavity such that airflow can pass through the cooling inlet through the motor cavity and out the outlet.

The ram fan device can further include a plurality of cooling inlets disposed in the housing. The ram fan device can further include an air scoop disposed on the housing to direct air into the cooling inlet. The cooling inlets can be sized to allow about 4 lbs/min to about 22 lbs/minute of airflow through the motor cavity.

The motor can include an electric motor having a rotor and a stator, wherein there is a gap between the rotor and the stator such that airflow can pass therethrough. The stator can include cooling passages such that airflow can pass therethrough.

In at least one aspect of this disclosure, a cooling system includes a ram air inlet, a ram inlet header in fluid communication with the ram air inlet, a ram outlet header in fluid communication with the ram inlet header, a liquid/air heat exchanger disposed between the ram inlet header and the ram outlet header, and a ram fan device as described above in fluid communication with the ram outlet header.

These and other features of the systems and methods of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1:
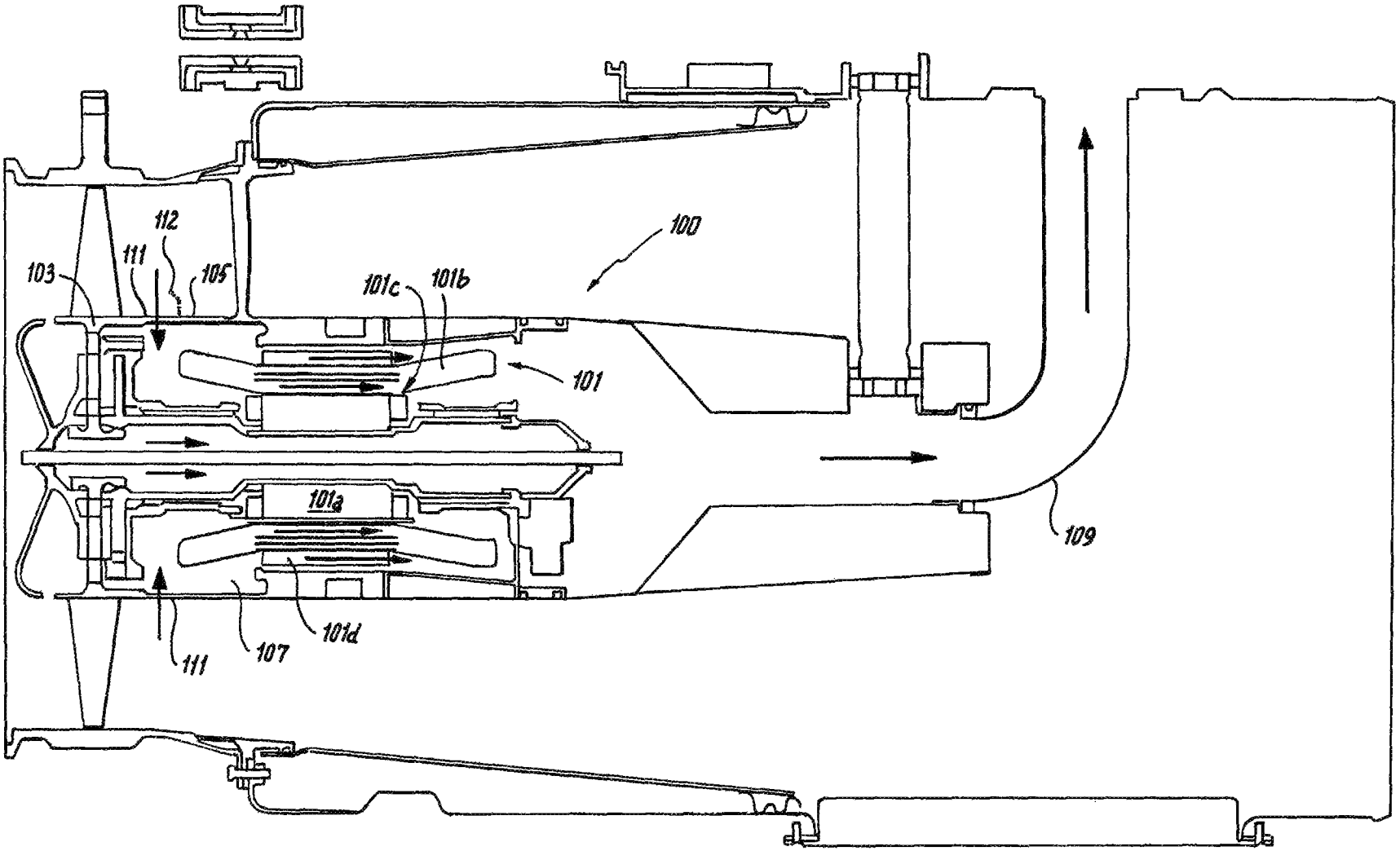
FIG. 1 is a cross-sectional view of a ram air fan in accordance with this disclosure, showing cooling inlets disposed in the housing aft of the fan blades.
Figure 2:
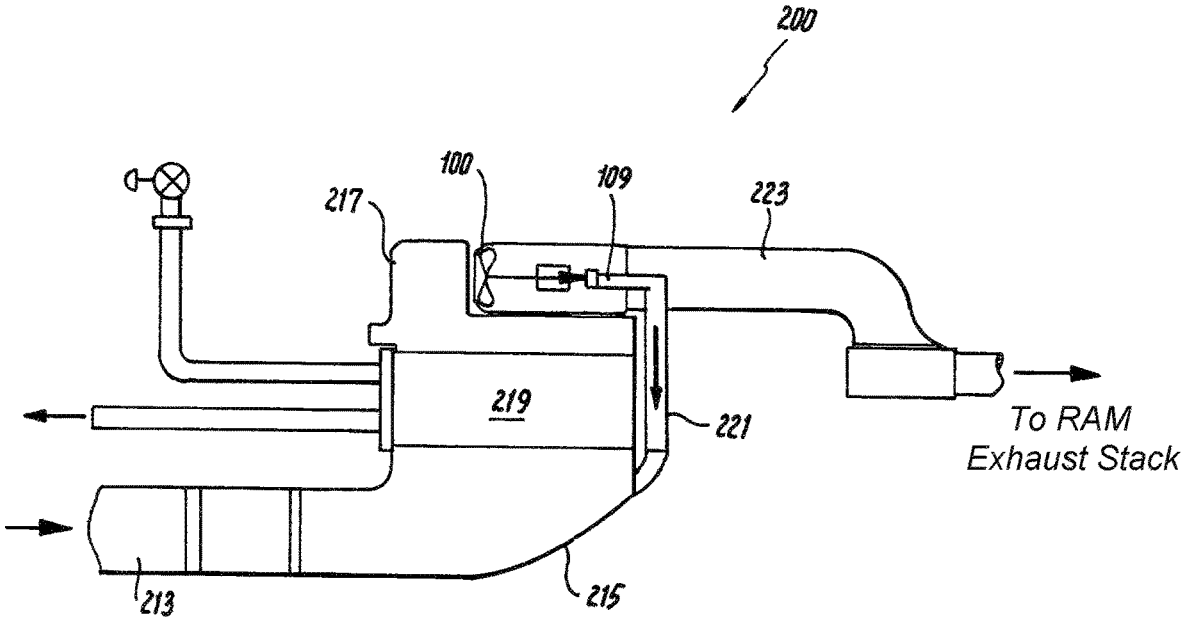
FIG. 2 is a schematic of a ram air cooling system in accordance with this disclosure, showing a motor cooling air outlet duct connected to a ram inlet header.
Figure 3:
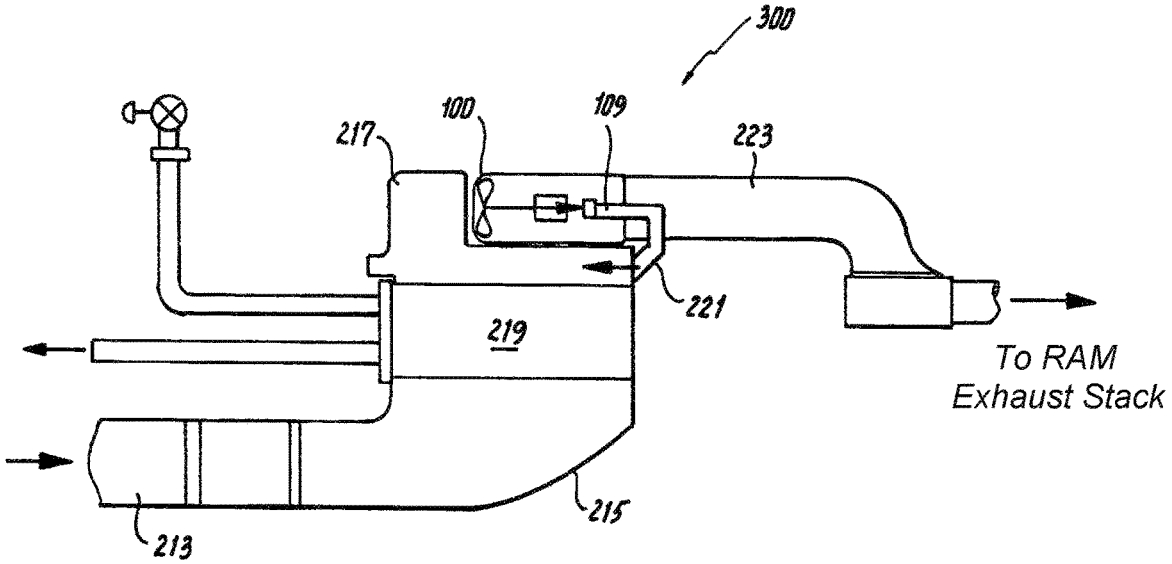
FIG. 3 is a schematic of a ram air cooling system in accordance with this disclosure, showing a motor cooling air outlet duct connected to a ram outlet header.

Reference will now be made to the drawings wherein like reference numerals identify similar structural features or aspects of the subject disclosure. For purposes of explanation and illustration, and not limitation, an illustrative view of an embodiment of a ram fan device in accordance with the disclosure is shown in FIG. 1 and is designated generally by reference character 100. Other embodiments and/or aspects of this disclosure are shown in FIGS. 2 and 3. The systems and methods described herein can be used to provide cooling for ram air fan motors.

Referring to FIG. 1, a ram fan device 100 includes a motor 101, a fan 103 operatively connected to the motor 101, and a housing 105 disposed around the motor 101 and defining a motor cavity 107. The housing 105 defined and/or is connected to an outlet 109 such that the motor cavity 107 and the outlet 109 are in fluid communication.

The housing 105 includes one or more cooling inlets 111 disposed aft of the fan 103 and forward of the motor 101. The cooling inlets 111 are in fluid communication with the motor cavity 107 and the outlet 109 such that airflow can pass through the cooling inlets 109, through the motor cavity 107, and into the outlet 109. While a plurality of cooling inlets 111 are shown, it is contemplated that a single cooling inlet 111 can be disposed in the housing 105. In certain embodiments, the ram fan device 100 can further include one or more air scoops 112 disposed on the housing 105 to direct air into the cooling inlet 111 in order to enhance airflow into the motor cavity 107 if needed for a given application.

In certain embodiments, the cooling inlets 111 can be dimensioned to allow about 4 lbs/min to about 22 lbs/minute of airflow through the motor cavity. Any other suitable cooling inlet size to allow any other suitable flow rate can be used as needed for a given application.

The motor 101 can be an electric motor having a rotor 101*a* and a stator 101*b*. A gap 101*c* between the rotor 101*a* and the stator 101*b* can exist such that airflow can pass therethrough. The stator 101*b* can include cooling passages 101*d* such that airflow can pass therethrough.

Using the above described configuration, airflow can be drawn through the fan 103, travel into the cooling inlets 111, into the motor cavity 107, through the motor 101, remove heat from the motor 101, and travel out through the outlet

109. This provides a larger amount of airflow to the motor 101 over traditional systems in conditions where only the fan is being operated.

Referring to FIG. 2, a cooling system 200 includes a ram air inlet 213, a ram inlet header 215 in fluid communication with the ram air inlet 213, and a ram outlet header 217 in fluid communication with the ram inlet header 215. A liquid/air heat 219 exchanger is disposed between the ram inlet header 215 and the ram outlet header 217. The system 200 also includes a ram fan device 100 as described above in fluid communication with the ram outlet header 217. As described above, a portion of the airflow travels into cooling inlets 111 of the device 100. The remainder of the flow travels to the ram air exhaust duct 223 to be exhausted from the system 200.

As shown in FIG. 2, the outlet 109 of device 100 is in fluid communication with a motor cooling duct 221. In this embodiment, the duct 221 is in fluid communication with the ram inlet header 215 to eject airflow from the motor cavity 107 upstream of the heat exchanger 219. In this configuration, an increased airflow will be experienced at the heat exchanger 219 relative to traditional systems which can further draw heat from the heat exchanger 219.

Air is drawn from the ram air fan outlet. Heat exchanger fins and extended surfaces of heat exchanger 219 are upstream of the ram air fan and can trap large FOD objects. In addition, the ram air fan outlet air can cause a swirling flow. In a swirling flow, since FOD is heavier than air, FOD will be disposed on the outer diameter, away from holes 111, and relatively cleaner air will be drawn by the motor cooling inlet holes 111 in to the motor cavity 107 for motor cooling. Thus, the motor cooling air will be clean and there will be less FOD entering into the motor cavity 107. Pressure differential between the ram fan outlet and inlet to the heat exchanger 219 can help drive the motor cooling air flow.

In another embodiment, as shown in FIG. 3, a motor cooling duct 321 of system 300 can be in fluid communication with the ram outlet header 217 to eject airflow from the motor cavity 107 downstream of the heat exchanger 219. Pressure differential between the ram air fan outlet and heat exchanger inlet or outlet can help draw the motor cooling air flow. It is also contemplated that the duct 321 can be purely exhausted to the atmosphere. While the above systems 200, 300 show motor cooling air recycled, the rise in flow rate will contribute to added heat transfer from the heat exchanger 219 and the motor 101.

Using the above described systems and devices, fine object debris (FOD) is prevented from traveling into the ducts 221, 321 which prevents clogging thereof and overheating of the motor 101 due to lack of cooling flow. Specifically, FOD that would have clogged traditional systems can be reduced in size by the fan 103 and/or pass over cooling inlets 111 without clogging. Also, at slow airspeeds where airflow is primarily induced by the ram fan device 100, the flow rate of air through the cooling holes is significantly improved, which improves heat transfer from the motor 101 even though the airflow is starting at a higher temperature from passing over a heat exchanger before arriving at the ram fan device 100.

The methods and systems of the present disclosure, as described above and shown in the drawings, provide for improved ram air fans and related systems with superior properties including improved thermal efficiency. While the apparatus and methods of the subject disclosure have been shown and described with reference to embodiments, those skilled in the art will readily appreciate that changes and/or modifications may be made thereto without departing from the spirit and scope of the subject disclosure.

What is claimed is:

1. A cooling system, comprising: a ram air inlet; a ram inlet header in fluid communication with the ram air inlet; a ram outlet header in fluid communication with the ram inlet header; a liquid/air heat exchanger disposed between the ram inlet header and the ram outlet header; a ram fan device in fluid communication with the ram outlet header, the ram fan device comprising: a motor; a fan connected to the motor; and a housing disposed around the motor and defining a motor cavity, the housing operative to connect to an outlet such that the motor cavity and the outlet are in fluid communication, wherein the housing includes at least one cooling inlet defined at least partially radially through a wall of the housing disposed instream with and downstream of the fan and also instream with and upstream of the motor, wherein the at least one cooling inlet is in fluid communication with the motor cavity and the outlet such that airflow can pass through the cooling inlet, through the motor cavity, and into the outlet; and a ram fan cooling duct connecting the outlet to the ram inlet header such that cooling flow passing through the motor cavity then passes through the outlet and into the ram inlet header.

2. The system of claim 1, wherein at least one cooling inlet includes a plurality of cooling inlets disposed in the housing.

3. The system of claim 2, wherein the cooling inlets are sized to allow about 4 lbs/min to about 22 lbs/minute of airflow through the motor cavity.

4. The system of claim 1, wherein the ram fan device includes an air scoop disposed on the housing to direct air into the at least one cooling inlet.

5. The system of claim 1, wherein the motor includes an electric motor having a rotor and a stator, wherein there is a gap between the rotor and the stator such that airflow can pass therethrough.

6. The system of claim 5, wherein the stator includes cooling passages such that airflow can pass therethrough.

* * * * *